US007645731B1

(12) United States Patent
Silvernail et al.

(10) Patent No.: US 7,645,731 B1
(45) Date of Patent: Jan. 12, 2010

(54) USE OF AMINOCARBOXYLATE FUNCTIONALIZED CATECHOLS FOR CLEANING APPLICATIONS

(75) Inventors: Carter Silvernail, Burnsville, MN (US); Erik Olson, Savage, MN (US)

(73) Assignee: Ecolab Inc., Eagan, MN (US)

( * ) Notice: Subject to any disclaimer, the term of this patent is extended or adjusted under 35 U.S.C. 154(b) by 0 days.

(21) Appl. No.: 12/350,799

(22) Filed: Jan. 8, 2009

(51) Int. Cl.
*C11D 3/33* (2006.01)

(52) U.S. Cl. ..... 510/480; 510/276; 510/499; 510/533; 510/318; 510/398; 510/434

(58) Field of Classification Search ..... 510/276, 510/480, 499, 533, 318, 398, 434
See application file for complete search history.

(56) References Cited

U.S. PATENT DOCUMENTS

| | | | | |
|---|---|---|---|---|
| 2,353,491 | A | | 7/1944 | Oberright |
| 2,363,134 | A | | 11/1944 | McCleary |
| 2,624,757 | A | | 1/1953 | Bersworth |
| 2,624,760 | A | | 1/1953 | Bersworth |
| 2,824,128 | A | | 2/1958 | Dexter |
| 2,967,196 | A | | 1/1961 | Kroll et al. |
| 3,038,793 | A | | 6/1962 | Kroll et al. |
| 3,048,548 | A | | 8/1962 | Martin et al. |
| 3,110,679 | A | | 11/1963 | Rubin |
| 3,334,147 | A | | 8/1967 | Brunelle et al. |
| 3,355,270 | A | | 11/1967 | Amick et al. |
| 3,442,242 | A | | 5/1969 | Laskey et al. |
| 3,454,497 | A | | 7/1969 | Wittner |
| 3,632,637 | A | | 1/1972 | Martell |
| 3,700,607 | A | | 10/1972 | Sundby et al. |
| 3,742,002 | A | | 6/1973 | Ohlson et al. |
| 3,758,540 | A | | 9/1973 | Martell |
| 3,812,044 | A | | 5/1974 | Connor et al. |
| 3,864,286 | A | | 2/1975 | Anderson |
| 4,025,451 | A | | 5/1977 | Plonsker et al. |
| 4,069,249 | A | | 1/1978 | Gaudette et al. |
| 4,116,991 | A | | 9/1978 | Leneuf |
| 4,130,582 | A | | 12/1978 | Petree et al. |
| 4,166,726 | A | | 9/1979 | Harle |
| 4,200,545 | A | | 4/1980 | Clason et al. |
| 4,225,502 | A | | 9/1980 | Gaudette et al. |
| 4,387,244 | A | | 6/1983 | Scanlon et al. |
| 4,618,914 | A | | 10/1986 | Sato et al. |
| 4,655,949 | A | | 4/1987 | Landry et al. |
| 4,734,212 | A | | 3/1988 | Harrison |
| 4,830,773 | A | | 5/1989 | Olson |
| 4,847,415 | A | | 7/1989 | Roling et al. |
| 4,883,580 | A | | 11/1989 | Roling et al. |
| 4,894,139 | A | | 1/1990 | Roling et al. |
| 4,960,536 | A | * | 10/1990 | Casciani ..... 510/479 |
| 5,025,103 | A | | 6/1991 | Oftring et al. |
| 5,028,517 | A | * | 7/1991 | Kuse et al. ..... 430/434 |
| 5,641,394 | A | | 6/1997 | Fisher et al. |
| 6,126,837 | A | | 10/2000 | Miknevich et al. |
| 6,228,179 | B1 | * | 5/2001 | Morinaga ..... 134/2 |
| 7,351,389 | B2 | | 4/2008 | Pillai et al. |
| 7,351,864 | B2 | | 4/2008 | Chiverton |
| 7,445,644 | B2 | | 11/2008 | Song et al. |

FOREIGN PATENT DOCUMENTS

| | | |
|---|---|---|
| EP | 0337937 | 10/1989 |

OTHER PUBLICATIONS du Moulinet d'Hardemare et al., "Solvent- and Catalyst-Free Selective Mannich Reaction on Catechols and Para Substituted Phenols: A Convenient Route to Catechol- and Phenol-Iminodiacetic Acid Ligands," Synthetic Communications, vol. 34, No. 21, pp. 3975-3988 (2004).

Schmitt et al., "Supramolecular Coordination Assemblies of Dinuclear Fe(III) Complexes," Angew. Chem. Int. Ed. 2005, 44, pp. 4187-4192.

Temkina et al., "New Sequestration Agents in the Naphthalene Series," All-Union Research Institute for Chemical Reagents and Particularly Pure Chemical Substances, pp. 1341-1344, 1971, Consultants Bureau—Plenum Publishing Co. (Translated from Zhurnal Obshchei Khimii, vol. 41, No. 6, pp. 1334-1337, Jun. 1971).

L'Eplattenier et al., "New Multidentate Ligands. VI. Chelating Tendencies of N,N'-Di(2-hydroxybenzyl) ethylenediamine-N,N'-diacetic Acid," Journal of the American Chemical Society, 89:4, pp. 837-843, Feb. 15, 1967.

Temkina et al., "Flourescent Complexones of the Naphthol Series," All-Union Research Institute for Chemical Reagents and Specially Pure Chemical Substances, pp. 1530-1334, 1976, Plenum Publishing Corp. (Translated from Zhurnal Obshchei Khimii, vol. 45, No. 7, pp. 1564-1570, Jul. 1975).

Frost et al., "Chelating Tendencies of N,N'-Ethylenebis-[2-(o-hydroxyphenyl)]-glycine," The Journal of the American Chemical Society, vol. 80, pp. 530-536, Feb. 5, 1958.

* cited by examiner

*Primary Examiner*—Charles I Boyer
(74) *Attorney, Agent, or Firm*—Faegre & Benson LLP

(57) ABSTRACT

A detergent composition is provided for preventing calcium, magnesium and iron precipitation and for removing soils. The detergent composition includes a caustic, a surfactant and an aminocarboxylate functionalized catechol. The detergent composition may include less than about 10% by weight phosphorous-containing compounds, NTA, and EDTA.

19 Claims, No Drawings

USE OF AMINOCARBOXYLATE FUNCTIONALIZED CATECHOLS FOR CLEANING APPLICATIONS

TECHNICAL FIELD

The present invention relates to the field of cleaning compositions. In particular, the present invention relates to cleaning compositions including an aminocarboxylate functionalized catechol as a chelating agent. The present invention also relates to methods employing these cleaning compositions.

BACKGROUND

Conventional detergents used in the vehicle care, warewashing and laundry industries include alkaline detergents. Alkaline detergents, particularly those intended for institutional and commercial use, generally contain phosphates, nitrilotriacetic acid (NTA) and ethylenediaminetetraacetic acid (EDTA). Phosphates, NTA and EDTA are components commonly used in detergents to sequester metal ions such as calcium, magnesium and iron.

In particular, NTA, EDTA or polyphosphates such as sodium tripolyphosphate and their salts are used in detergents because of their ability to prevent calcium, magnesium and iron from precipitating and/or solublize preexisting inorganic salts and/or soils. When calcium, magnesium and iron salts precipitate, the crystals may attach to the surface being cleaned and cause undesirable effects. For example, calcium carbonate precipitation on the surface of ware can negatively impact the aesthetic appearance of the ware, giving an unclean look. In the laundering area, if calcium carbonate precipitates and attaches onto the surface of fabric, the crystals may leave the fabric feeling hard and rough to the touch. The ability of NTA, EDTA and polyphosphates to remove metal ions facilitates the detergency of the solution by preventing hardness precipitation, assisting in soil removal and/or preventing soil redeposition into the wash solution or wash water.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can replace the properties of phosphorous-containing compounds such as phosphates, phosphonates, phosphites, and acrylic phosphinate polymers, as well as non-biodegradable aminocarboxylates such as NTA and EDTA.

SUMMARY

The present invention relates to cleaning compositions employing an aminocarboxylate functionalized catechol as a chelating agent. The present cleaning compositions are biodegradable. The present invention also relates to methods employing these cleaning compositions.

In an embodiment, a detergent composition is provided for preventing calcium, magnesium and iron precipitation and for removing soils. The detergent composition includes a caustic, a surfactant and an aminocarboxylate functionalized catechol. The detergent composition may include less than about 10% by weight phosphorous-containing compounds, NTA, and EDTA.

While multiple embodiments are disclosed, still other embodiments of the present invention will become apparent to those skilled in the art from the following detailed description, which shows and describes illustrative embodiments of the invention.

DETAILED DESCRIPTION

Cleaning Composition

The present invention relates to cleaning compositions including an aminocarboxylate functionalized catechol as a chelating agent. Cleaning compositions including an aminocarboxylate functionalized catechol may be biodegradable and substantially free of phosphorous and aminocarboxylates such as NTA and EDTA, making the cleaning composition particularly useful in cleaning applications where it is desired to use an environmentally friendly detergent The cleaning composition can be applied in any environment where it is desirable to prevent the precipitation of magnesium, calcium and iron. For example, the cleaning composition can be used in vehicle care applications, warewashing applications, laundering applications and food and beverage applications. Such applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, and industrial or household cleaners. Methods of using the cleaning composition are also provided.

The present invention is a cleaning composition that exhibits detergency, soil suspension and anti-redeposition properties typically attributed to phosphorous and aminocarboxylates in common cleaning compositions. Unlike most cleaning compositions currently known in the art, the cleaning composition of the present invention does not require that phosphorous, NTA or EDTA be present in order to be effective. The cleaning composition may be used in solid form or in liquid form. In solid form, the composition may take forms including, but not limited to: a cast, extruded, molded or formed solid pellet, block, tablet, powder, granule, flake, and the like, or the formed solid or aggregate can thereafter be ground or formed into a powder, granule, flake, and the like.

The cleaning composition generally includes an aminocarboxylate functionalized catechol, an alkalinity source, and a surfactant or surfactant system. A suitable concentration range of the components in the cleaning composition includes between approximately 1% and approximately 40% by weight aminocarboxylate functionalized catechol, between approximately 1% and approximately 40% by weight alkalinity source and between approximately 1% and approximately 25% by weight surfactant or surfactant system. A particularly suitable concentration range of the components in the cleaning composition includes between approximately 1% and approximately 25% by weight aminocarboxylate functionalized catechol, between approximately 1% and approximately 25% by weight alkalinity source and between approximately 1% and approximately 10% by weight surfactant or surfactant system. It should be understood that the concentration of aminocarboxylate functionalized catechol in the cleaning composition will vary depending on whether the cleaning composition is provided as a concentrate or as a use solution. For example, a suitable concentration range of aminocarboxylate functionalized catechol in a concentrate is between approximately 1% and approximately 40% by weight and particularly between approximately 1% and approximately 25% by weight. A suitable concentration of the aminocarboxylate functionalized catechol in a concentrate is less than about 25% A suitable concentration range of aminocarboxylate functionalized catechol in a use solution is between approximately 0.001% and approximately 20% by weight and particularly between approximately 0.001% and approximately 10% by weight. A more particularly suitable concentration of the aminocarboxylate functionalized catechol in a use solution is between approximately 0.001% and 5%. A suitable concentration of aminocarboxylate functionalized catechol in a use solution is less than about 10%. Those skilled in the art will appreciate other suitable component concentration ranges for obtaining comparable properties of the cleaning composition.

A general formula for a suitable aminocarboxylate functionalized catechol includes:

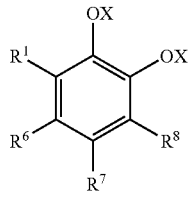

Where:

$R^1$ is $NR^3R^4$ or $R^2NR^3R^4$, $R^2$ is selected from the group consisting of a lower alkyl group from about 1 to about 4 carbon atoms, at least one of $R^3$ and $R^4$ is $R^5(COOH)_2$, $R^5$ is selected from the group consisting of lower linear alkyl from about 1 to about 4 carbon atoms, $R^6$, $R^7$ and $R^8$ are selected from the group consisting of: hydrogen, $SO_3X$, COOX, halogen, alkoxy group, a lower alkyl group from about 1 to about 4 carbon atoms, an amine having the general formula —$N(R^9)_2$ where $R^9$ is a lower alkyl group from about 1 to about 4 carbon atoms, a hydroxyalkyl group from about 1 to about 4 carbon atoms or any combination thereof, and X is selected from the group consisting of hydrogen, an alkali metal ion, one half of an alkaline earth metal ion, and an ammonium ion with the general formula:

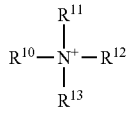

Where:

Each of $R^{10}$, $R^{11}$, $R^{12}$ and $R^{13}$ is a lower alkyl group having from about 1 to about 4 carbon atoms, a hydroxyalkyl group having from about 1 to about 4 carbon atoms or any combination thereof.

Examples of suitable aminocarboxylate functionalized catechols include, but are not limited to: 2,2'-[(2,3-dihydroxy-5-sulfobenzyl)imino)]diacetic acid ($C_{11}H_{13}NO_9S$); 2,2'-[(2,3-dihydroxy-4-sulfobenzyl)imino]diacetic acid ($C_{11}H_{13}NO_9S$); 2,2'-[(2,3-dihydroxy-4-methylbenzyl)imino]diacetic acid ($C_{12}H_{15}NO_6$); 2,2'-[(2,3-dihydroxy-5-methylbenzyl)imino]diacetic acid ($C_{12}H_{15}NO_6$); 3-{[bis(carboxymethyl)amino]methyl}-4,5-dihydroxybenzoic acid ($C_{12}H_{13}NO_8$); 2,2'-{[2,3-dihydroxy-5-(1-hydroxyethyl)benzyl]imino}diacetic acid ($C_{13}H1_7NO_7$); 2,2'-[(5-chloro-2,3-dihydroxybenzyl)imino]diacetic acid ($C_{11}H_{12}NO_6Cl$); 2,2'-[(2,3-dihydroxy-5-methoxybenzyl)imino]diacetic acid ($C_{12}H_{15}NO_7$); 2,2'-{[5-(dimethylamino)-2,3-dihydroxybenzyl]imino}diacetic acid ($C_{13}H_{18}N_2O_6$); 2,2'-{[2-(2,3-dihydroxyphenyl)ethyl]imino}diacetic acid ($C_{12}H_{15}NO_6$); 2,2'-{[2-(2,3-dihydroxy-5-sulfophenyl)ethyl]imino}diacetic acid ($C_{12}H_{15}NO_9S$); 2,2'-{[2-(2,3-dihydroxy-4,6-disulfophenyl)ethyl]imino}diacetic acid ($C_{12}H_{15}NO_{12}S_2$); 2,2'-{[2-(2,3-dihydroxy-5-methoxyphenyl)ethyl]imino}diacetic acid ($C_{13}H_{17}NO_7$); 2,2'-{[2-(5-chloro-2,3-dihydroxyphenyl)ethyl]imino}diacetic acid ($C_{12}H_{14}NO_6Cl$); and 2,2'-({2-[2,3-dihydroxy-5-(1-hydroxyethyl)phenyl]ethyl}imino)diacetic acid ($C_{14}H_{19}NO_7$). Examples of particularly suitable aminocarboxylate functionalized catechols include, but are not limited to: 2,2-[2,3-dihydroxybenzyl)imino]diacetic acid ($C_{11}H_{13}NO_6$), also known as catechol aminocarboxylate; 2,2-[2,3-dihydroxy-4,6-disulfobenzyl)imino]diacetic acid ($C_{11}H_{13}NO_{12}S_2$), also known as tiron aminocarboxylate; (2,2-[2,3-dihydroxy-5-methylbenzyl)imino]diacetic acid or 2,2-[2,3-dihydroxy-6-methylbenzyl)imino]diacetic acid ($C_{12}H_{15}NO_6$), also known as 4-methylcatechol aminocarboxylate; and (2,2-[2,3-dihydroxy-5-methylbenzyl)imino]diacetic acid or 2,2-[2,3-dihydroxy-4-methoxybenzyl)imino]diacetic acid ($C_{12}H_{15}NO_7$), also known as 3-methoxycatechol aminocarboxylate.

Without being bound by theory, it is believed that the aminocarboxylate functionalized catechol acts as a chelating agent to prevent the precipitation of calcium, magnesium and iron. Without being bound by theory, it is also believed that the aminocarboxylate functionalized catechol acts as a chelating agent to sequester calcium, magnesium and iron from already formed inorganic salts or soils. The term "sequester" refers to chelating, solublizing, binding, coordinating, capturing, or removing the metal ion. It is believed that the performance of the aminocarboxylate functionalized catechol may be effected by the substituent groups located on the benzene ring. The aminocarboxylate functional group is an effective functionality for binding calcium and magnesium while the two alcohol groups are effective for binding iron. It is believed that this combination of the aminocarboxylate functional group and the two alcohol groups makes the aminocarboxylate functionalized catechol particularly effective as a chelating agent. This arrangement of functional groups provides five-membered chelate rings resulting in enhanced kinetic stability when coordinated to a metal ion.

The examples below suggest that the substituent groups located on the aromatic ring influence the performance of the aminocarboxylate functionalized catechol. In the examples below, the catechol aminocarboxylate and the tiron aminocarboxylate generally outperformed the 4-methylcatechol aminocarboxylate and 3-methoxycatechol aminocarboxylate. Without being bound by theory, this suggests that having a hydrogen (catechol aminocarboxylate) or electron withdrawing groups such as sulfonates (tiron aminocarboxylate) increases the covalent character of the coordinate bonds and may enhance electron delocalization through the coordinate bonds.

The cleaning composition also includes an alkalinity source, such as an alkali metal hydroxide, alkali metal carbonate, or alkali metal silicate. Examples of suitable alkalinity sources include, but are not limited to: sodium carbonate, sodium hydroxide, or a mixture of sodium carbonate and sodium hydroxide. The alkalinity source controls the pH of the resulting solution when water is added to the cleaning composition to form a use solution. The pH of the use solution must be maintained in the alkaline range in order to provide sufficient detergency properties. In an embodiment, the pH of the use solution is between approximately 9 and approximately 12. If the pH of the use solution is too low, for example, below approximately 9, the use solution may not provide adequate detergency properties. If the pH of the use solution is too high, for example, above approximately 12, the use solution may be too alkaline and attack or damage the surface to be cleaned.

The cleaning composition also includes a surfactant or surfactant system. A variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference.

Examples of suitable anionic surfactants useful in the cleaning composition, include, but are not limited to: carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like. Some particularly suitable anionic surfactants include, but are not limited to: sodium alkylarylsulfonate, alpha-olefinsulfonate, and fatty alcohol sulfates.

Nonionic surfactants useful in the cleaning composition include those having a polyalkylene oxide polymer as a portion of the surfactant molecule. Examples of suitable nonionic surfactants include, but are not limited to: chlorine-, benzyl-, methyl-, ethyl-, propyl, butyl- and alkyl-capped polyethylene glycol ethers of fatty alcohols; polyalkylene oxide free nonionics such as alkyl polyglucosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer. Examples of suitable commercially available nonionic surfactants include, but are not limited to: PLURONIC, available from BASF Corporation, Florham Park, N.J. and ABIL B8852, available from Goldschmidt Chemical Corporation, Hopewell, Va.

Cationic surfactants useful for inclusion in the cleaning composition include, but are not limited to: amines such as primary, secondary and tertiary amines with C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl(C12-C18)dimethylbenzyl ammonium chloride, n-tetradecyldimethylbenzylammonium chloride monohydrate, and naphthalene-substituted quaternary ammonium chlorides such as dimethyl-1-naphthylmethylammonium chloride. For a more extensive list of surfactants, see McCutcheon's Emulsifiers and Detergents, which is incorporated herein by reference.

Additional Functional Materials

The cleaning composition may contain other functional materials that provide desired properties and functionalities to the cleaning composition. For the purpose of this application, the term "functional materials" includes a material that when dispersed or dissolved in a use and/or concentrate solution, such as an aqueous solution, provides a beneficial property in a particular use. Examples of such functional materials include, but are not limited to: alkaline sources; organic detergents, surfactants or cleaning agents; rinse aids; bleaching agents; sanitizers/anti-microbial agents; activators; detergent builders or fillers; defoaming agents, anti-redeposition agents; optical brighteners; dyes/odorants; secondary hardening agents/solubility modifiers; pesticides for pest control applications; or the like, or a broad variety of other functional materials, depending upon the desired characteristics and/or functionality of the composition. Some more particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Rinse Aids

The cleaning composition can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

Bleaching Agents

The cleaning composition can optionally include a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloramine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

Sanitizers/Anti-Microbial Agents

The cleaning composition can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the cleaning composition can be enhanced by the addition of a material which, when the cleaning composition is placed in use, reacts with the active oxygen to form an activated component. For example, in some embodiments, a peracid or a peracid salt is formed. For example, in some embodiments, tetraacetylethylene diamine can be included within the cleaning composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, the cleaning composition is in the form of a solid block, and an activator material for the active oxygen is coupled to the solid block. The activator can be coupled to the solid block by any of a variety of methods for coupling one solid cleaning composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the cleaning composition, such as by a plastic or shrink wrap or film.

Detergent Builders or Fillers

The cleaning composition can optionally include a minor but effective amount of one or more of a detergent filler which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and C1-C10 alkylene glycols such as propylene glycol.

pH Buffering Agents

Additionally, the cleaning composition can be formulated such that during use in aqueous operations, for example in aqueous cleaning operations, the wash water will have a desired pH. For example, compositions designed for use in providing a presoak composition may be formulated such that during use in aqueous cleaning operations the wash water will have a pH in the range of about 6.5 to about 12, and in some embodiments, in the range of about 7.5 to about 11. Liquid product formulations in some embodiments have a (10% dilution) pH in the range of about 7.5 to about 11.0, and in some embodiments, in the range of about 7.5 to about 9.0.

For example, a souring agent may be added to the cleaning composition such that the pH of the textile approximately matches the proper processing pH. The souring agent is a mild acid used to neutralize residual alkalines and reduce the pH of the textile such that when the garments come into contact with human skin, the textile does not irritate the skin. Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid (C20). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids. Examples of suitable commercially available souring agents include, but are not limited to: TurboLizer, Injection Sour, TurboPlex, AdvaCare 120 Sour, AdvaCare 120 Sanitizing Sour, CarboBrite, and Econo Sour, all available from Ecolab Inc., St. Paul, Minn.

Fabric Relaxants

A fabric relaxant may be added to the cleaning composition to increase the smoothness appearance of the surface of the textile.

Fabric Softeners

A fabric softener may also be added to the cleaning composition to soften the feel of the surface of the textile. An example of a suitable commercially available fabric softener includes, but is not limited to, TurboFresh, available from Ecolab Inc., St. Paul, Minn.

Soil Releasing Agents

The cleaning composition can include soil releasing agents that can be provided for coating the fibers of textiles to reduce the tendency of soils to attach to the fibers. Examples of suitable commercially available soil releasing agents include, but are not limited to: polymers such as Repel-O-Tex SRP6 and Repel-O-Tex PF594, available from Rhodia, Cranbury, N.J.; TexaCare 100 and TexaCare 240, available from Clariant Corporation, Charlotte, N.C.; and Sokalan HP22, available from BASF Corporation, Florham Park, N.J.

Defoaming Agents

The cleaning composition can optionally include a minor but effective amount of a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548 to Martin et al., 3,334,147 to Brunelle et al., and 3,442,242 to Rue et al., the disclosures of which are incorporated by reference herein.

Anti-Redeposition Agents

The cleaning composition can optionally include an anti-redeposition agent capable of facilitating sustained suspension of soils in a cleaning solution and preventing the removed soils from being redeposited onto the substrate being cleaned. Examples of suitable anti-redeposition agents include, but are not limited to: fatty acid amides, fluorocarbon surfactants, complex phosphate esters, polyacrylates, styrene maleic anhydride copolymers, and cellulosic derivatives such as hydroxyethyl cellulose, hydroxypropyl cellulose.

Stabilizing Agents

The cleaning composition may also include stabilizing agents. Examples of suitable stabilizing agents include, but are not limited to: borate, calcium/magnesium ions, propylene glycol, and mixtures thereof.

Dispersants

The cleaning composition may also include dispersants. Examples of suitable dispersants that can be used in the solid detergent composition include, but are not limited to: maleic acid/olefin copolymers, polyacrylic acid, and mixtures thereof.

Optical Brighteners

The cleaning composition can optionally include an optical brightener, also referred to as a fluorescent whitening agent or a fluorescent brightening agent, and can provide optical compensation for the yellow cast in fabric substrates.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry detergent products are used to clean a variety of fabrics, the detergent compositions may contain a mixture of brighteners which are effective for a variety of fabrics. It is of course necessary that the individual components of such a brightener mixture be compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5- and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal 5 BM-GX, Tinopal CBS-CL, Tinopal CBS-X, and Tinopal AMS-GX, available from Ciba Specialty Chemicals Corporation, Greensboro, N.C. Examples of optical brighteners are also disclosed in "The Production and Application of Fluorescent Brightening Agents", M. Zahradnik, Published by John Wiley & Sons, New York (1982), the disclosure of which is incorporated herein by reference.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene.

Anti-Static Agents

The cleaning composition can include an anti-static agent such as those commonly used in the laundry drying industry to provide anti-static properties. Anti-static agents can generate a percent static reduction of at least about 50% when compared with a textile that is not subjected to treatment. The percent static reduction can be greater than 70% and it can be greater than 80%. An example of an anti-static agent includes, but is not limited to, an agent containing quaternary groups.

Anti-Wrinkling Agents

The cleaning composition can include anti-wrinkling agents to provide anti-wrinkling properties. Examples of anti-wrinkling suitable agents include, but are not limited to: siloxane or silicone containing compounds and quaternary ammonium compounds. Particularly suitable examples of anti-wrinkling agents include, but are not limited to: polydimethylsiloxane diquaternary ammonium, silicone copolyol fatty quaternary ammonium, and polydimethyl siloxane with polyoxyalkylenes. Examples of commercially available anti-wrinkling agents include, but are not limited to: Rewoquat SQ24, available from Degussa/Goldschmidt Chemical Corporation, Hopewell, Va.; Lube SCI-Q, available from Lambert Technologies; and Tinotex CMA, available from Ciba Specialty Chemicals Corporation, Greensboro, N.C.

Odor-Capturing Agents

The cleaning composition can include odor capturing agents. In general, odor capturing agents are believed to function by capturing or enclosing certain molecules that provide an odor. Examples of suitable odor capturing agents include, but are not limited to: cyclodextrins and zinc ricinoleate.

Fiber Protection Agents

The cleaning composition can include fiber protection agents that coat the fibers of the textile to reduce or prevent disintegration and/or degradation of the fibers. An example of a fiber protection agent includes, but is not limited to, cellulosic polymers.

Color Protection Agents

The cleaning composition can include color protection agents for coating the fibers of a textile to reduce the tendency of dyes to escape the textile into water. Examples of suitable color protection agents include, but are not limited to: quaternary ammonium compounds and surfactants. Examples of particularly suitable color protection agents include, but are not limited to: di-(nortallow carboxyethyl)hydroxyethyl methyl ammonium methylsulfate and cationic polymers. Examples of commercially available surfactant color protection agents include, but are not limited to: Varisoft WE 21 CP and Varisoft CCS-1, available from Degussa/Goldschmidt Chemical Corporation, Hopewell, Va.; Tinofix CL from Ciba Specialty Chemicals Corporation, Greensboro, N.C.; Color Care Additive DFC 9, Thiotan TR, Nylofixan P-Liquid, Polymer VRN, Cartaretin F-4, and Cartaretin F-23, available from Clariant Corporation, Charlotte, N.C.; EXP 3973 Polymer, available from Alcoa Inc., Pittsburgh, Pa.; and Coltide, available from Croda International Plc, Edison N.J.

Dyes/Odorants

Various dyes, odorants including perfumes, and other aesthetic enhancing agents may also be included in the cleaning composition. Examples of suitable commercially available dyes include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

UV Protection Agents

The cleaning composition can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An example of a suitable commercially available UV protection agent includes, but is not limited to, Tinosorb FD, available from Ciba Specialty Chemicals Corporation, Greensboro, N.C.

Anti-Pilling Agents

The cleaning composition can include an anti-pilling agent that acts on portions of fibers that stick out or away from the fiber. Anti-pilling agents can be available as enzymes such as cellulase enzymes. Examples of commercially available anti-pilling agents include, but are not limited to: Puradex, available from Genencor International, Pal Alto, Calif.; and Endolase and Carezyme, available from Novozyme, Franklinton, N.C.

Water Repellency Agents

The cleaning composition can include water repellency agents that can be applied to textile to enhance water repellent properties. Examples of suitable water repellenancy agents include, but are not limited to: perfluoroacrylate copolymers, hydrocarbon waxes, and polysiloxanes.

Hardening Agents/Solubility Modifiers

The cleaning composition may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time.

Insect Repellants

The cleaning composition can include insect repellents such as mosquito repellents. An example of a commercially available insect repellent is DEET. In addition, the aqueous carrier solution can include mildewcides that kill mildew and allergicides that reduce the allergic potential present on certain textiles and/or provide germ proofing properties.

Pest Control Agents

In cleaning compositions intended for use in pest control applications, an effective amount of pest control agents, such as pesticide, attractant, and/or the like may be included. A pesticide is any chemical or biological agent used to kill pests such as, for example, insects and rodents. Examples of pesticides include, but are not limited to: an insecticide or a rodenticide. Examples of rodenticides include, but not are not limited to: difethialone, bromadiolone, brodifacoum, and mixtures thereof.

Other Ingredients

A wide variety of other ingredients useful in providing the particular composition being formulated to include desired properties or functionality may also be included. For example, the cleaning compositions may include other active ingredients, cleaning enzyme, carriers, processing aids, solvents for liquid formulations, or others, and the like.

Use Compositions

The present cleaning compositions may include concentrate compositions or may be diluted to form use compositions. In general, a concentrate refers to a composition that is intended to be diluted with water to provide a use solution that contacts an object to provide the desired cleaning, rinsing, or the like. The cleaning composition that contacts the articles to be washed can be referred to as the use composition. The use solution can include additional functional ingredients at a level suitable for cleaning, rinsing, or the like. In an embodiment, the use solution includes additional functional ingredients of from about 0.05 wt % to about 75 wt %.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 500 but will depend on factors including water hardness, the amount of soil to be removed and the like. In an embodiment, the concentrate is diluted at a ratio of between about 1:10 and about 2500:1 water to concentrate. Particularly, the concentrate is diluted at a ratio of between about 100:1 and about 1500:1 water to concentrate. More particularly, the concentrate is diluted at a ratio of between about 250:1 and about 500:1 water to concentrate. When the cleaning composition is diluted to a use solution, the aminocarboxylate functionalized catechol is effective at concentrations of between about 10 parts per million (ppm) and about 400,000 ppm and particularly between about 50 ppm and about 250,000 ppm. In particular, the aminocarboxylate functionalized catechol is effective at concentrations of less than approximately 60,000 ppm and less than approximately 20,000 ppm. When diluted to a use solution, the cleaning composition includes phosphorous-containing components, NTA and EDTA concentrations of less than approximately 100 ppm, preferably less than approximately 10 ppm, and most preferably less than approximately 1 ppm.

The use composition can have a solids content that is sufficient to provide the desired level of detersive properties while avoiding wasting the cleaning composition. The solids concentration refers to the concentration of the non-water components in the use composition. In an embodiment when the composition is provided as a use solution, the use composition can have a solids content of at least about 0.05 wt % to provide a desired level of cleaning. In addition, the use composition can have a solids content of less than about 1.0 wt % to avoid using too much of the composition. The use composition can have a solids content of about 0.05 wt % to about 0.75 wt %.

The concentrate may be diluted with water at the location of use to provide the use solution. The use solution is then applied onto the surface for an amount of time sufficient to remove soils from the surface. In an exemplary embodiment, the use solution remains on the surface of at least approximately 4 minutes to effectively remove the soils from the surface. The use solution is then rinsed from the surface.

Embodiments of Liquids and Solids

The present invention relates to liquid and solid cleaning compositions including an aminocarboxylate functionalized catechol chelating agent. For example, when the composition is provided as a liquid, the present invention includes a gel or paste including an aminocarboxylate functionalized catechol chelating agent. For example, when the composition is provided as a solid, the present invention includes a cast solid including an aminocarboxylate functionalized catechol chelating agent.

Exemplary ranges for components of the cleaning composition when provided as a gel or a paste are shown in Table 1. Exemplary ranges for components of the cleaning composition when provided as a solid are shown in Table 2.

TABLE 1

Gel or Paste Cleaning Composition

| Component | First Exemplary Range (wt %) | Second Exemplary Range (wt %) | Third Exemplary Range (wt %) |
|---|---|---|---|
| Water | 5-60 | 10-35 | 15-25 |
| Alkaline Source | 5-40 | 10-30 | 15-20 |
| Silicate | 0-35 | 5-25 | 10-20 |
| Builder/Filler | 1-45 | 3-20 | 6-15 |
| Aminocarboxylate functionalized catechol | 1-40 | 1-30 | 1-15 |
| Stabilizer | 0-20 | 0.5-15 | 2-10 |
| Dispersant | 0-20 | 0.5-15 | 2-9 |
| Enzyme | 0-15 | 0.5-10 | 1-5 |
| Corrosion Inhibitor | 0.01-15 | 0.5-10 | 1-5 |
| Surfactant | 0.05-15 | 0.5-10 | 1-5 |
| Fragrance | 0-10 | 0.01-5 | 0.1-2 |
| Dye | 0-1 | 0.001-0.5 | 0.01-0.25 |

TABLE 2

Solid Cleaning Composition

| Component | First Exemplary Range (wt %) | Second Exemplary Range (wt %) | Third Exemplary Range (wt %) |
|---|---|---|---|
| Water | 0-50 | 1-30 | 5-20 |
| Alkaline Source | 5-40 | 10-30 | 15-20 |
| Builder/Filler | 1-60 | 25-50 | 35-45 |
| Aminocarboxylate functionalized catechol | 1-40 | 1-30 | 1-15 |
| Bleach | 0-55 | 5-45 | 10-35 |
| Silicate | 0-35 | 5-25 | 10-15 |
| Dispersant | 0-10 | 0.001-5 | 0.01-1 |
| Enzyme | 0-15 | 1-10 | 2-5 |
| Corrosion Inhibitor | 0.01-15 | 0.05-10 | 1-5 |
| Surfactant | 0.05-15 | 0.5-10 | 1-5 |
| Fragrance | 0-10 | 0.01-5 | 0.1-2 |
| Dye | 0-1 | 0.001-0.5 | 0.01-0.25 |

The present aminocarboxylate functionalized catechol chelating agent of the cleaning composition can be provided in any of a variety of embodiments of compositions. In an embodiment, the cleaning composition is substantially free of phosphorous-containing compounds, nitrilotriacetic acid (NTA) and ethylenediaminetetraacetic acid (EDTA) to make the solid detergent composition more environmentally acceptable. Substantially phosphorous-free refers to a composition to which phosphorous-containing compounds are not added. Should phosphorus-containing compounds be present through contamination, the level of phosphorus-containing compounds in the resulting composition is less than approximately 10 wt %, less than approximately 5 wt %, less than approximately 1 wt %, less than approximately 0.5 wt %, less than approximately 0.1 wt %, and often less than approximately 0.01 wt %. Substantially NTA or EDTA-free refers to a composition to which NTA or EDTA are not added. Should NTA or EDTA be present through contamination, the level of NTA or EDTA in the resulting composition is less than approximately 10 wt %, less than approximately 5 wt %, less than approximately 1 wt %, less than approximately 0.5 wt %, less than approximately 0.1 wt %, and often less than approximately 0.01 wt %. When the cleaning composition is NTA-free, the cleaning composition is also compatible with chlorine, which functions as an anti-redeposition and stain-removal agent.

The cleaning composition may be made using a mixing process. The cleaning composition, including the aminocarboxylate functionalized catechol, alkalinity source, surfactant or surfactant system and other functional ingredients are mixed for an amount of time sufficient to completely dissolve the components to form a final, homogeneous composition. In an exemplary embodiment, the components of the cleaning composition are mixed for approximately 10 minutes.

A solid cleaning composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the detergent composition under the expected conditions of storage and use of the solid cleaning composition. In general, it is expected that the detergent composition will remain a solid when provided at a temperature of up to about 100° F. or greater than about 120° F.

In certain embodiments, the solid cleaning composition is provided in the form of a unit dose. A unit dose refers to a solid cleaning composition unit sized so that the entire unit is used during a single cycle, for example, a single washing cycle of a warewash machine. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 111,000 g.

In other embodiments, the solid cleaning composition is provided in the form of a multiple-use solid, such as, a block or a plurality of pellets, and can be repeatedly used to generate aqueous detergent compositions for multiple washing cycles. In certain embodiments, the solid cleaning composition is provided as a solid having a mass of about 5 g to about 10 kg. In certain embodiments, a multiple-use form of the solid cleaning composition has a mass of about 1 to about 10 kg. In further embodiments, a multiple-use form of the solid cleaning composition has a mass of about 5 kg to about 8 kg. In other embodiments, a multiple-use form of the solid cleaning composition has a mass of about 5 g to about 1 kg, or about 5 g and to about 500 g.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Chelating Ability of Aminocarboxylate Functionalized Catechols

Various compositions were prepared including either a chelating agent of the present invention or a known chelating agent. A plurality of clean 2" by 2" pieces of marble tiles were weighed and then lowered into each of the compositions. The temperature of each composition was preset at either 70° F. (room temperature) or 160° F. Each of the marble tiles were positioned to contact its respective composition such that about ⅛" of the marble tile projected above the surface of the composition. After about 30 minutes, each of the marble tiles was removed from the composition, rinsed, and dried for about 30 minutes about 160° F. and reweighed. The amount of weight loss corresponded to the amount of calcium carbonate removed. Generally, a more substantial amount of calcium carbonate will be removed with chelating agents having large $Ca^{2+}$ stability constant.

Examples 1, 2, 3 and 4 and Comparative Examples A, B, C and D

The compositions of Examples 1, 2, 3 and 4 included an aminocarboxylate functionalized catechol as a chelating agent. In particular, the composition of Example 1 included catechol aminocarboxylate, the composition of Example 2 included tiron aminocarboxylate, the composition of Example 3 included 4-methylcatechol aminocarboxylate and the composition of Example 4 included 3-methoxycatechol aminocarboxylate. Each of the compositions also included an effective amount of sodium hydroxide to adjust the pH of the composition to about 11 and included either about 20,000 ppm or about 60,000 ppm of the aminocarboxylate functionalized catechol.

The compositions of Comparative Examples A, B and C were prepared similarly to the compositions of Examples 1-4 except that the compositions of Comparative Examples A-C included known chelating agents. In particular, the composition of Comparative Example A included EDTA, the composition of Comparative Example B included NTA, and the composition of Comparative Example C included Dissolvine GL-38-S. Dissolvine GL-38-S is a glutamic acid-N,N-diacetic acid tetrasodium salt, 38% aqueous, available from Akzo Nobel Polymer Chemicals, Amsterdam, Netherlands. The composition of Comparative Example D was used as a control and included water.

Table 3 provides the average weight percent of calcium carbonate removed from the marble tiles for each of the compositions of Examples 1-4 and Comparative Examples A-D at chelating agent concentrations of about 20,000 ppm and about 60,0000 ppm and temperatures of about 70° F. (room temperature) and about 160° F. Generally, two compositions are regarded as performing substantially similarly, and would therefore function as effective replacements of each other, if the amount of soil removed by each composition varied within about 10%.

TABLE 3

| | Average Calcium Carbonate Removed (%) | | | |
|---|---|---|---|---|
| | Room Temperature | | 160° F. | |
| | 20,000 ppm | 60,000 ppm | 20,000 ppm | 60,000 ppm |
| Example 1 | 0.1660 | 0.2814 | 0.2343 | 0.6393 |
| Example 2 | 0.1254 | 0.1798 | 0.1699 | 0.5662 |
| Example 3 | 0.0260 | 0.0976 | 0.0591 | 0.1721 |
| Example 4 | 0.1248 | 0.1835 | 0.1687 | 0.5681 |
| Comparative Ex. A | 0.1315 | 0.3135 | 0.2568 | 0.8023 |
| Comparative Ex. B | 0.1337 | 0.2324 | 0.2466 | 0.5920 |
| Comparative Ex. C | 0.0856 | 0.1733 | 0.1449 | 0.3097 |
| Comparative Ex. D | 0.0003 | 0.0031 | 0.0011 | −0.0234 |

As illustrated in Table 3, the cleaning composition of Example 1 outperformed the cleaning composition of Comparative Example A at room temperature and low concentration by over about 20%. However, at room temperature and higher concentration, the cleaning composition of Example 1 performed slightly less effectively than the cleaning composition of Comparative Example A, removing about 10% or less soil. At high temperature and concentration, the cleaning composition of Comparative Example A outperformed the cleaning composition of Example 1 by about 20%. With regard to the cleaning compositions of Comparative Examples B and C, the cleaning composition of Example 1 removed a greater weight percentage of calcium carbonate at substantially all test conditions. In particular, at room temperature, the cleaning composition of Example 1 outperformed the cleaning compositions of Comparative Examples B and C by at least 15%. The only time that the cleaning composition of Example 1 was outperformed by the cleaning composition Comparative Example B was at a concentration of 20,000 ppm and a temperature of 160° F., when the cleaning composition of Comparative Example B removed only about 5% more calcium carbonate than the cleaning composition of Example 1. The results in Table 3 indicate that catechol aminocarboxylate has substantially equal chelating ability for calcium carbonate as commercially known and used chelating agents and would be an effective replacement for EDTA, NTA and Dissolvine GL-38-S.

At room temperature and a concentration of about 20,000 ppm, the cleaning composition of Example 2 removed substantially the same amount of calcium carbonate as the cleaning compositions of Comparative Examples A and B. However, as the concentration and the temperature of the cleaning compositions increased, the cleaning compositions of Comparative Examples A and B outperformed the cleaning composition of Example 2. At all test conditions, the cleaning composition of Example 2 outperformed the cleaning composition of Comparative Example C by between about 3.5% and about 45%. The results in Table 3 indicate that tiron aminocarboxylate would an effective replacement for EDTA, NTA and Dissolvine GL-38-S, three known and used chelating agents, for binding calcium carbonate.

The cleaning composition of Example 3, which contained 4-methylcatechol aminocarboxylate, did not remove as much calcium carbonate as the cleaning compositions of Comparative Examples A, B or C at any of the test conditions. These results indicate that 4-methylcatechol aminocarboxylate has a substantially smaller stability constant than EDTA, NTA and GL-38-S. However, the cleaning composition of Example 3 did remove some calcium carbonate from solution.

The cleaning composition of Example 4, which contained 3-methoxycatechol aminocarboxylate, performed slightly less effectively than the cleaning compositions of Comparative Examples A and B at both concentrations and temperatures. However, the cleaning composition of Example 4 outperformed the cleaning composition of Comparative Example C by between about 5.5% and about 45% at all test conditions.

As illustrated in Table 3, all of the cleaning compositions of Examples 1-4 and Comparative Examples A, B and C exhibited greater chelating properties than the control cleaning composition of Comparative Example D, which included only water.

The compositions of Example 1-4 were then compared to the compositions of Comparative Examples A, B, and C using equal molar quantities instead of equal weighted quantities. These tests were performed at concentrations of 0.0777 M and 0.2333 M at both room temperature and at about 160° F. The results are shown below in Table 4. Again, two compositions are regarded as performing substantially similarly if the amount of soil removed by each composition varied within about 10%.

TABLE 4

| | Average Calcium Carbonate Removed (%) | | | |
|---|---|---|---|---|
| | Room Temperature | | 160° F. | |
| | 0.0777 M | 0.2333 M | 0.0777 M | 0.2333 M |
| Example 1 | 0.2161 | 0.4661 | 0.3902 | 0.8989 |
| Example 2 | 0.2648 | 0.2448 | 0.5924 | 0.9550 |
| Example 3 | 0.0402 | 0.1805 | 0.0916 | 0.2372 |
| Example 4 | 0.1251 | 0.1923 | 0.2038 | 0.1517 |
| Comparative Ex. A | 0.1741 | 0.3767 | 0.3554 | 0.9323 |
| Comparative Ex. B | 0.1042 | 0.2463 | 0.1601 | 0.4607 |
| Comparative Ex. C | 0.1078 | 0.2484 | 0.2000 | 0.3474 |

As illustrated in Table 4, the cleaning composition of Example 1 removed a greater percentage of calcium carbonate than the cleaning compositions of Comparative Examples A, B and C at substantially all test conditions. In particular, at room temperature, the cleaning composition of Example 1 outperformed the cleaning compositions of Comparative Example A by about 19%, Comparative Example B by at least about 47% and Comparative Example C by at least about 46%. At higher temperatures, the cleaning composition of Example 1 still outperformed the cleaning compositions of Comparative Examples A, B and C, but at a lower percentage. The only time that the cleaning composition of Example 1 was outperformed was by the cleaning composition of Comparative Example B at a concentration of 0.2333 M and a temperature of 160° F., when the cleaning composition of Comparative Example A removed about 3.6% more calcium carbonate than the cleaning composition of Example 1. The results in Table 4 indicate that catechol aminocarboxylate has substantially equal chelating ability for calcium carbonate as commercially known and used chelating agents and would be an effective replacement for EDTA, NTA and Dissolvine GL-38-S.

Similarly, the cleaning composition of Example 2 removed a greater percentage of calcium carbonate than the cleaning compositions of Comparative Examples A, B and C at substantially all test conditions. In particular, at a concentration of about 0.0777 M and at room temperature, the cleaning composition of Example 2 outperformed the cleaning compositions of Comparative Example A by about 34% and Comparative Examples B and C by about 60%. At a higher concentration, the cleaning composition of Example 2 performed slightly less effectively than the cleaning composition of Comparative Example A, but performed substantially similarly to the cleaning compositions of Comparative Examples B and C. At a temperature of about 160° F., the cleaning composition of Example 2 performed slightly better than the cleaning composition of Comparative Example A and outperformed the cleaning compositions of Comparative Examples B and C by between about 50% and about 73%. The results in Table 4 indicate that tiron aminocarboxylate has substantially equal chelating ability for calcium carbonate as commercially known and used chelating agents and would be an effective replacement for EDTA, NTA and Dissolvine GL-38-S.

The cleaning composition of Example 3, which contained 4-methylcathechol aminocarboxylate, did not remove as much calcium carbonate as the cleaning compositions of Comparative Examples A, B or C at any of the test conditions.

However, the cleaning composition of Example 3 did remove some calcium carbonate from solution.

At lower concentrations and room temperature, the cleaning composition of Example 4 outperformed the cleaning compositions of Comparative Examples B and C. At higher temperatures and concentrations, the cleaning composition of Example 4 did not perform as effectively as the cleaning compositions of the comparative examples. These results indicate that 3-methoxycatechol aminocarboxylate may be used as an effective replacement for NTA and Dissolvine GL-38-S.

Warewashing Test

To determine the relative touchless cleaning ability of vehicle presoaks including aminocarboxylate functionalized catechols on tough soils, a plurality of 3" by 6" black panels were soiled with road side dirt. Black panels were used because they were determined to provide the highest visible contrast between a dirty, filmed surface and a clean surface.

A 200 milliliter (ml) sample of standard vehicle drying agent was made using about 2 ml of drying agent at a 100:1 water to drying agent dilution and poured into a pan. Clean and dry panels were rinsed in the drying agent and then rinsed with soft water. The drying agent was used to help coat the surface of the panel with the soil more uniformly. After the panels were rinsed with the drying agent, the pan was rinsed out and filled with about 200 ml of water and about 100-150 grams (g) of soil from Northern California and Denver. Both soils had a mixture of either iron silicate or bentonite, motor oil, brake dust, organic matter and fine sand/silica to form a thin, mud-like solution.

Each panel was then placed into the pan and the pan was agitated until the panel could be lifted out of the pan while maintaining a uniform coating of mud across its surface. As the panel was slowly removed from the pan, the water and soil were allowed to drain from the surface. The surface of the panels were not touched during this process.

Once coated, the panel was placed into an oven set at a temperature of about 80° C. to dry for about 10 minutes. The dirt was baked onto the panels a total of 3 times with the soil. The final coated panel was then thoroughly rinsed with soft water and dried. The final rinsed and dried panels had a visible film on the surface which was easily removed by friction but was very difficult to remove only by chemical action and water rinsing.

To test the ability of chelating agents to remove soil from the surface of the panel, a single drop of presoak solution was dropped onto the surface of the panel. Each of the compositions used Blue Coral 3600 as a base, a detergent available from Ecolab, Inc., St. Paul, Minn. The compositions were diluted at ratios of about 250:1 and about 500:1 water to chelating agent. The compositions were allowed to remain on the panel surface for about 1-2 minutes to permit cleaning action. The panel surface was then thoroughly rinsed with soft water and allowed to dry.

Comparisons were made versus controls by measuring the percent soil removal (% SR). The % SR was determined with a BYK Gardner TRI-gloss meter using a 60° gloss geometry. The % SR was measured by comparing the gloss readings of a clean panel ($X_0$), a soiled panel ($X_s$), and a panel after cleaning with a detergent ($X_c$). The percent soil removal was calculated using the following equation:

$$\%SR=((X_c-X_s)/(X_0-X_s))\times 100$$

The average soil removal percentages reported in Tables 5 and 6 were determined by measuring the % SR for multiple spots per panel and calculating the average of these values (to ensure reproducibility).

Examples 5, 6, 7 and 8 and Comparative Examples E and F

Comparative Example E used Blue Coral 3600, which includes both EDTA and gluconate, both known to aid in soil removal. The cleaning composition of Comparative Example F included all of the components of the original composition of the Blue Coral 3600 except that the EDTA was removed.

The cleaning compositions of Examples 5, 6, 7 and 8 removed the EDTA from the original Blue Coral 3600 composition and replaced it with an aminocarboxylate functionalized catechol at equal weight percentages. In particular, the composition of Example 5 included catechol aminocarboxylate, the composition of Example 6 included tiron aminocarboxylate, the composition of Example 7 included 4-methylcatechol aminocarboxylate and the composition of Example 8 included 3-methoxycatechol aminocarboxylate.

Table 5 provides the average percent of soil removed by each of the cleaning compositions of Examples 5-8 and Comparative Examples E and F at dilution ratios of 250:1 and 500:1 for soils from Northern California and Denver. Compositions are regarded as performing substantially similarly if the amount of soil removed by each composition varied by about 10% or less.

TABLE 5

| | Average Soil Removal (%) | | | |
|---|---|---|---|---|
| | Northern California Soil | | Denver Soil | |
| | 250:1 Dilution | 500:1 Dilution | 250:1 Dilution | 500:1 Dilution |
| Example 5 | 41.11 | 36.50 | 33.47 | 31.57 |
| Example 6 | 30.20 | 33.56 | 33.47 | 31.57 |
| Example 7 | 33.10 | 21.71 | 31.81 | 19.94 |
| Example 8 | 27.67 | 18.85 | 34.17 | 23.26 |
| Comparative Example E | 43.21 | 33.83 | 41.13 | 33.5 |
| Comparative Example F | 39.14 | 27.75 | 27.37 | 23.90 |

As illustrated in Table 5, the cleaning composition of Example 5 performed substantially similarly to the commercially available cleaning composition of Comparative Example E. In particular, the difference in the abilities of the cleaning compositions of Example 5 and Comparative Example E in removing Northern California Soil was less than about 8% at any of the test conditions. The cleaning composition of Example 5 also substantially outperformed the cleaning composition of Comparative Example F, particularly at higher dilution ratios, removing about 24% more soil. Thus, the data in Table 5 suggests that catechol aminocarboxylate is a suitable replacement for EDTA in cleaning compositions.

The cleaning composition of Comparative Example E outperformed the cleaning composition that included tiron aminocarboxylate (Example 6) at a dilution ratio of 250:1 in removing both Northern California soil and Denver soil. However, as the dilution ratio increased to about 500:1, the cleaning composition of Example 6 performed substantially similarly to the cleaning composition of Comparative Example E with a difference in soil removal of less than about 6%. The cleaning composition of Example 6 removed more soil than the cleaning composition of Comparative Example F at almost all test conditions by at least about 17%. The data in Table 5 suggests that tiron aminocarboxylate is a suitable replacement for EDTA in cleaning compositions.

In removing both Northern California soil and Denver soil, the cleaning composition of Example 7, which included 4-methylcatechol aminocarboxylate, did not remove as much soil as the cleaning compositions of Comparative Examples E and F. However, the 4-methylcatechol aminocarboxylate did exhibit soil removing capabilities.

In removing Northern California soil, the cleaning composition of Example 8, which included 3-methoxycatechol aminocarboxylate, did not remove as much soil as the cleaning compositions of Comparative Examples E and F. In removing Denver soil, the cleaning composition of Example 8 either performed substantially similarly or outperformed the cleaning composition of Comparative Example F. Thus, the 3-methoxycatechol aminocarboxylate may be a suitable replacement for EDTA for removing Denver soil.

Examples 9, 10, 11 and 12 and Comparative Examples E, F, and G

The cleaning compositions of Examples 9, 10, 11 and 12 removed both the EDTA and gluconate from the original Blue Coral 3600 composition and replaced them with an aminocarboxylate functionalized catechol at equal weight percentages. In particular, the composition of Example 9 included catechol aminocarboxylate, the composition of Example 10 included tiron aminocarboxylate, the composition of Example 11 included 4-methylcatechol aminocarboxylate and the composition of Example 12 included 3-methoxycatechol aminocarboxylate.

Comparative Examples E and F are the same as described above. Comparative Example G included all of the components of the original composition of the Blue Coral 3600 except that the EDTA and gluconate were removed from the original composition in Comparative Example G.

Table 6 provides the average percent of soil removed by each of the cleaning compositions of Examples 9-12 and Comparative Examples E-G at dilution ratios of 250:1 and 500:1 for soils from Northern California and Denver. Again, compositions are regarded as performing substantially similarly if the amount of soil removed by each composition varied by about 10% or less.

TABLE 6

| | Average Soil Removal (%) | | | |
|---|---|---|---|---|
| | Northern California Soil | | Denver Soil | |
| | 250:1 Dilution | 500:1 Dilution | 250:1 Dilution | 500:1 Dilution |
| Example 9 | 45.17 | 43.82 | 41.05 | 43.30 |
| Example 10 | 36.79 | 34.48 | 41.05 | 43.30 |
| Example 11 | 35.70 | 25.45 | 31.64 | 24.47 |
| Example 12 | 31.48 | 17.99 | 33.76 | 19.36 |
| Comparative Example E | 43.21 | 33.83 | 41.13 | 33.5 |
| Comparative Example F | 39.14 | 27.75 | 27.37 | 23.90 |
| Comparative Example G | 21.65 | 17.42 | 24.44 | 19.2 |

At lower dilutions ratios, the cleaning composition of Example 9 performed substantially similarly to the commercially available cleaning composition of Comparative Example E in removing both Northern California and Denver soil. At higher dilution ratios, the cleaning composition of Example 9 outperformed the cleaning composition of Comparative Example E, removing more than about 22% more soil. At all test conditions, the cleaning composition of Example 9 substantially outperformed the cleaning composition of Comparative Example F, removing anywhere between about 13% and about 45% more soil. The data in Table 6 thus suggests that catechol aminocarboxylate would be a suitable replacements for EDTA and gluconate in cleaning compositions.

Except for removing Northern California soil at a low dilution level, the cleaning composition of Example 10, which included tiron aminocarboxylate, performed substantially similarly to the commercially available cleaning composition of Comparative Example E. Except for removing Northern California soil at a low dilution level, the cleaning composition of Example 10 also outperformed the cleaning composition of Comparative Example F. In particular, when removing Northern California soil at a dilution ratio of about 250:1, the cleaning composition of Comparative Example F removed about 14% more soil than the cleaning composition of Example 10. However, at a dilution ratio of 500:1, the cleaning composition of Example 10 removed about 22% more Denver soil than the cleaning composition of Comparative Example F. The data in Table 6 suggests that tiron aminocarboxylate would be a suitable replacements for EDTA and gluconate in cleaning compositions.

The cleaning composition of Example 11, which included 4-methylcatechol aminocarboxylate, did not remove as much Northern California soil or Denver soil as the cleaning composition of Comparative Example E. However, the cleaning composition of Example 11 did outperform Comparative Example F in removing Denver soil. Thus, the 4-methylcatechol aminocarboxylate may be a suitable alternative for EDTA in removing Denver soil.

The cleaning composition of Example 12, which included 3-methoxycatechol aminocarboxylate, did not remove as much Northern California soil or Denver soil as the cleaning compositions of Comparative Examples E or F. However, the cleaning composition of Example 12 did remove some soil and may be a suitable alternative for EDTA and gluconate.

As illustrated in Table 6, all of the cleaning compositions of Examples 9-12, which replaced both the EDTA and gluconate from the original formulation of Blue Coral 3600 with an aminocarboxylate functionalized catechol, exhibited greater soil removing properties than the cleaning composition of Comparative Example G, which did not include any EDTA or gluconate. This result indicates that all of the aminocarboxylate functionalized catechols exhibit at least some soil removing properties.

100 Cycle Warewash Film Test

To determine the ability of a composition including an aminocarboxylate functionalized catechol of the present invention to sequester hard water in a warewash detergent, a 100 cycle film test was performed.

A 100 cycle warewash test was performed using six 10 oz. Libbey glasses in a Hobart AM-14 warewash machine. Before testing, all of the glasses were prepared by removing all film and foreign material from the surfaces of the glasses. The warewash machine was filled with the appropriate amount of water and the water was tested for hardness. The warewash machine was then turned on and wash and rinse cycles were run until a wash temperature of about 150-160° F. and a rinse temperature of about 175-190° F. were reached.

Before the test was started, the sump was primed with about 200 grams of detergent. The glasses were then positioned diagonally in the rack and the rack was placed inside the warewash machine. After each cycle, about 6.5 L of water was removed from the warewash machine and replaced with new water. The water in each cycle was about 17 grains per gallon of hot water. Due to the corresponding drop in detergent concentration, about 20 grams of detergent was manually added to maintain the initial concentration after each cycle.

The amounts of spots and films on the glasses were rated on a scale of 1 to 5. A rating of 1 indicated no spots and no films. A rating of 2 indicated a random amount of spots that cover less than about a quarter of the glass surface and a trace amount of film that was barely perceptible under intense spot light conditions. A rating of 3 indicated that about a quarter of the glass surface was covered with spots and a slight film was present when held up to a florescent light source. A rating of 4 indicated that about half of the glass surface was covered with spots and a moderate amount of film was present such that the glass surface appeared hazy when held up to a florescent light source. A rating of 5 indicated that the entire glass surface was coated with spots and a heavy amount of filming was present such that the glass surface appears cloudy when held up to a florescent light source.

Examples 14, 15, 16, and 17 and Comparative Examples H and I

Examples 14, 15, 16 and 17 included cleaning compositions of the present invention using an aminocarboxylate functionalized catechol as the chelating agent. In particular, the composition of Example 14 used catechol aminocarboxylate, the composition of Example 15 used tiron aminocarboxylate, the composition of Example 16 used 4-methylcatechol aminocarboxylate and the composition of Example 17 used 3-methoxycatechol aminocarboxylate. In addition to the aminocarboxylate functionalized catechol, the cleaning compositions also included sodium hydroxide and water.

Comparative Example H was the control and included a mixture of sodium hydroxide and water. Comparative Example I was a control and included a mixture of tetrasodium EDTA and water.

The amounts of chelating agent used was based on the moles of hardness in the water expressed as calcium carbonate, or chelating agent:moles hardness expressed as calcium carbonate. The component concentrations of the compositions of Examples 14-17 and Comparative Examples H and I are listed below in Table 7.

TABLE 7

| | Example 14 | Example 15 | Example 16 | Example 17 | Comparative Example H | Comparative Example I |
|---|---|---|---|---|---|---|
| Sodium Hydroxide, 50% (g) | 536 | 536 | 536 | 536 | 536 | 0 |
| Tetrasodium EDTA, 99% (g) | 0 | 0 | 0 | 0 | 0 | 968 |
| Catechol aminocarboxylate, 80% active (g) | 1241 | 0 | 0 | 0 | 0 | 0 |
| Tiron aminocarboxylate, 83% active (wt %) (g) | 0 | 1764 | 0 | 0 | 0 | 0 |
| 4-methylcatechol aminocarboxylate, 76% active (g) | 0 | 0 | 1346 | 0 | 0 | 0 |
| 3-methoxycatechol aminocarboxylate, 71% active (g) | 0 | 0 | 0 | 1504 | 0 | 0 |
| Water (g) | 723 | 200 | 618 | 460 | 1964 | 996 |

The average spot ratings and film ratings for glasses treated with the compositions of Examples 14, 15, 16, and 17 and Comparative Examples H and I are illustrated below in Table 8. Generally, a spot or film rating of 3 or above is generally considered unacceptable.

TABLE 8

| | Spot Rating | Film Rating |
|---|---|---|
| Example 14 | 1 | 1 |
| Example 15 | 1 | 1 |
| Example 16 | 1 | 2.2 |
| Example 17 | 1 | 2.3 |
| Comparative Example H | — | 5 |
| Comparative Example I | 1 | 1 |

As can be seen in Table 8, the glasses washed with the cleaning composition of Comparative Example H, which did not include any chelating agent, were coated with spots and a heavy amount of filming. By contrast, the glasses washed with the cleaning composition of Comparative Example I, which included a known chelating agent, tetrasodium EDTA, resulted in glasses having substantially no spotting or filming.

Substantially no spotting or filming were present on the glasses washed with the cleaning compositions of Examples 14 and 15. Catechol aminocarboxylate (Example 14) and tiron aminocarboxylate (Example 15) can thus be used as effective chelating agents in warewashing compositions to prevent the appearance of spots and film on ware being washed.

While the glasses washed with the cleaning compositions of Example 16 (4-methylcatechol aminocarboxylate) and Example 17 (3-methoxycatechol aminocarboxylate) had acceptable spot ratings, the film ratings indicated a trace amount of film that was barely perceptible under intense spot light condition. Thus, 4-methylcatechol aminocarboxylate and 3-methoxycatechol aminocarboxylate can be used as effective chelating agents in warewashing compositions to prevent the appearance of spots and film on ware being washed.

Examples 18, 19, 20 and 21 and Comparative Examples H and I

Once it was determined that the catechol aminocarboxylate and tiron amioncarboxylate performed comparably to the cleaning composition of Comparative Example I at a 1:1 molar ratio of aminocarboxylate functionalized catechol to calcium carbonate, the ratios of the catechol aminocarboxylate and tiron amioncarboxylate to calcium carbonate in the water were reduced to about 0.6:1 chelating agent:moles hardness expressed as calcium carbonate to determine whether they would still perform as effectively as the control. In particular, Example 18 included catechol aminocarboxylate and Example 19 included tiron amioncarboxylate.

Similarly, once it was determined that the 4-methylcatechol aminocarboxylate and the 3-methoxycatechol aminocarboxylate did not perform comparably to the control (Comparative Example I) at a 1:1 mole ratio, the ratios of the 4-methylcatechol aminocarboxylate and the 3-methoxycatechol aminocarboxylate to calcium carbonate in the water were increased to about 1.25:1 aminocarboxylate functionalized catechol:moles hardness expressed as calcium carbonate to determine whether they would then perform as effectively as the control. In particular, Example 20 included 4-methylcatechol aminocarboxylate and Example 21 included 3-methoxycatechol aminocarboxylate.

Comparative Examples H and I were again used as the controls.

The component concentrations of the chelating agent and water are illustrated below in Table 9.

TABLE 9

| | Example 18 | Example 19 | Example 20 | Example 21 | Comparative Example H | Comparative Example I |
|---|---|---|---|---|---|---|
| Sodium Hydroxide, 50% (g) | 536 | 536 | 536 | 536 | 536 | 0 |
| Tetrasodium EDTA, 99% (g) | 0 | 0 | 0 | 0 | 0 | 968 |
| Catechol aminocarboxylate, 80% active (g) | 745 | 0 | 0 | 0 | 0 | 0 |
| Tiron aminocarboxylate, 83% active (wt %) (g) | 0 | 1058 | 0 | 0 | 0 | 0 |
| 4-methylcatechol aminocarboxylate, 76% active (g) | 0 | 0 | 1690 | 0 | 0 | 0 |
| 3-methoxycatechol aminocarboxylate, 71% active (g) | 0 | 0 | 0 | 1181 | 0 | 0 |
| Water (g) | 1219 | 906 | 274 | 83 | 1964 | 996 |

The average spot ratings and film ratings for the compositions of Examples 18, 19, 20, and 21 and Comparative Examples H and I are illustrated below in Table 10. Again, a spot or film rating of 2 or above is considered unacceptable.

TABLE 10

| | Spot Rating | Film Rating |
|---|---|---|
| Example 18 | 1 | 2.5 |
| Example 19 | 1 | 2.6 |
| Example 20 | 1 | 1.3 |
| Example 21 | 1 | 1.4 |
| Comparative Example H | — | 5 |
| Comparative Example I | 1 | 1 |

As can be seen in Table 10, when the molar ratios of catechol aminocarboxylate and tiron amioncarboxylate to calcium carbonate in the water were reduced to about 0.6:1, the effectiveness of catechol aminocarboxylate (Example 18) and tiron amioncarboxylate (Example 19) decreased to result in an unacceptable film rating. While the spot ratings remained acceptable, the film ratings increased to over 2. Thus, while catechol aminocarboxylate and tiron aminocarboxylate can be effectively used as chelating agents in warewashing compositions at a 1:1 molar ratio of aminocarboxylate functionalized catechol:calcium carbonate, as the molar ratio decreases, the effectiveness decreases and becomes unacceptable at least at a molar ratio of about 0.6:1.

As the ratios of the 4-methylcatechol aminocarboxylate (Example 20) and the 3-methoxycatechol aminocarboxylate (Example 21) to calcium carbonate in the water were increased to about 1.25:1 chelating agent:moles hardness expressed as calcium carbonate, the effectiveness of the chelating agents increased to acceptable spot and film ratings. Thus, both 4-methylcatechol aminocarboxylate and 3-methoxycatechol aminocarboxylate would function at effective replacements for tetrasodium EDTA at between a 1:1 and 1.25:1 ratio chelating agent:moles hardness expressed as calcium carbonate in the water.

Laundry Test

To determine the ability of compositions including an aminocarboxylate functionalized catechol to remove soil, various laundering tests were performed. Each of the compositions used Formula 1 as a base, a laundry detergent available from Ecolab, Inc., St. Paul, Minn.

A plurality of artificially soiled cotton, polycotton and cotton polyester durable press swatches were soiled and washed with the various compositions. The soils included make-up, dirty motor oil, soot/olive oil and dust sebum. The amount of soil present on each swatch was determined by measuring the reflectance, or lightness (L) value using a Hunterlab Colorquest XE spectrophotometer. Three large cotton napkin backers, each containing six different types of swatches, were attached to the cloth backers.

The washing machine was charged with about 25-28 pounds of cotton sheets along with the three backers which were evenly distributed inside the wash drum. Each laundry test was performed at a water temperature of about 140° F. Approximately 250 g of composition was used per wash.

After each wash, the swatches were dried and the reflectances (L-value) were again measured. The percent soil removed was calculated from the difference between the initial L value and the final L value. The soil removal value (SR) was calculated from the following equation:

$$SR=((L_w-L_{uw})/(L_0-L_{uw}))\times 100\%$$

Where:

SR=Soil removal (%)

$L_w$=Lightness of the washed swatch $L_{uw}$=Lightness of the soiled, unwashed swatch $L_0$=Lightness of the white swatch before soiling.

Examples 22, 23, 24 and 25 and Comparative Example J

Comparative Example J used Formula 1, which includes EDTA, known to aid in soil removal.

Examples 22, 23, 24 and 25 included cleaning compositions of the present invention using an aminocarboxylate functionalized catechol as the chelating agent. All of the compositions of Examples 22-25 removed the EDTA from the original Formula 1 composition and replaced it with an aminocarboxylate functionalized catechol and balance water. In particular, the composition of Example 22 used catechol aminocarboxylate, the composition of Example 23 used tiron aminocarboxylate, the composition of Example 24 used 4-methylcatechol aminocarboxylate and the composition of Example 25 used 3-methoxycatechol aminocarboxylate.

The component concentrations of the chelating agent and water are illustrated below in Table 11.

TABLE 11

| | Example 22 | Example 23 | Example 24 | Example 25 | Comp. Ex. J |
|---|---|---|---|---|---|
| Tetrasodium EDTA (wt %) | 0 | 0 | 0 | 0 | 6 |
| Catechol aminocarboxylate, 20% active (wt %) | 30 | 0 | 0 | 0 | 0 |
| Tiron aminocarboxylate, 27% active (wt %) | 0 | 22.2 | 0 | 0 | 0 |
| 4-methylcatechol aminocarboxylate, 25% active (wt %) | 0 | 0 | 23.8 | 0 | 0 |
| 3-methoxycatechol aminocarboxylate, 30% active (wt %) | 0 | 0 | 0 | 19.8 | 0 |
| DI Water | 291 | 299 | 291 | 301 | 315 |

The individual and average percent soil removal for the compositions of Examples 22-25 and Comparative Example J are listed below in Table 12. Generally, two cleaning compositions were considered to perform substantially similarly, and thus function as effective replacements for one another, when the performance of the two cleaning compositions did not vary by more than about 10%.

TABLE 12

| | Average Soil Removal (%) | | | | |
|---|---|---|---|---|---|
| Soil | Example 22 | Example 23 | Example 24 | Example 25 | Comp. Ex. J |
| Makeup on Cotton | 21.3 | 20.34 | 17.46 | 14.84 | 20.55 |
| Dirty Motor Oil on Cotton | 6.9 | 10.16 | 4.58 | 7.33 | 9.75 |
| EMPA 101 | 19.21 | 23.44 | 20.5 | 19.07 | 19.3 |
| EMPA 104 | 23.82 | 23.9 | 22.62 | 22.00 | 24.06 |
| Dust Sebum on Polycotton | 50.83 | 53.36 | 50 | 46.66 | 57.29 |
| Dust Sebum on Cotton | 29.56 | 33.35 | 28.28 | 30.24 | 36.77 |
| Average | 25.27 | 27.43 | 23.91 | 23.35 | 27.95 |
| Std. Deviation | 3.67 | 3.26 | 3.25 | 3.64 | 2.98 |

As can be seen in Table 12, the cleaning composition of Example 22 containing catechol aminocarboxylate removed substantially the same percent of soil as the cleaning composition of Comparative Example J under all test conditions. On average, the cleaning composition of Comparative Example J removed about 9.6% more soil than the cleaning composition of Example 22. Thus, catechol aminocarboxylate would be an effective replacement for EDTA in laundry detergent compositions.

Similarly, the cleaning composition of Example 23 containing tiron aminocarboxylate removed substantially the same percent of soil as the cleaning composition of Comparative Example J. On average, the cleaning composition of Comparative Example J only removed about 2% more soil than the cleaning composition of Example 23. Thus, tiron aminocarboxylate would be an effective replacement for EDTA in laundry detergent compositions.

The 4-methylcatechol aminocarboxylate and 3-methoxycatechol aminocarboxylate in the cleaning compositions of Example 24 and Example 25, respectively, were not as effective as the cleaning composition of Comparative Example J in removing soil. On average, the cleaning composition of Comparative Example J removed about 14.5% more soil than the cleaning composition of Example 24 and about 16.5% more soil than the cleaning composition of Example 25. However, when the standard deviation is taken into account, the compositions performed substantially similarly. Thus, 4-methylcatechol aminocarboxylate and 3-methoxycatechol aminocarboxylate would be an effective replacement for EDTA in laundry detergent compositions.

Examples 26, 27, 28 and 29 and Comparative Example J

Once it was determined that the catechol aminocarboxylate and tiron amioncarboxylate performed comparably to the control (Comparative Example J) at a 1:1 weight ratio, the weights of the catechol aminocarboxylate and tiron amioncarboxylate were reduced by 25% to determine whether they would still perform as effectively as the control. In particular, Example 26 included catechol aminocarboxylate and Example 27 included tiron amioncarboxylate.

Although it was determined that the 4-methylcatechol aminocarboxylate and 3-methoxycatechol aminocarboxylate performed comparably to the control (Comparative Example J) at a 1:1 mole ratio when taking into account the standard deviation, the performances differed by more than about 10% when the standard deviation was not taken into account. Thus, the ratios of the 4-methylcatechol aminocarboxylate and 3-methoxycatechol aminocarboxylate to EDTA were increased to about 1.25:1 to determine whether the 4-methylcatechol aminocarboxylate and 3-methoxycatechol aminocarboxylate would perform substantially as effectively as the control. In particular, Example 28 included 4-methylcatechol aminocarboxylate and Example 29 included 3-methoxycatechol aminocarboxylate.

Comparative Example J was again used as the control.

The component concentrations of the chelating agent and water are illustrated below in Table 13.

TABLE 13

| | Example 26 | Example 27 | Example 28 | Example 29 | Comp. Ex. J |
|---|---|---|---|---|---|
| Tetrasodium EDTA (wt %) | 0 | 0 | 0 | 0 | 6 |
| Catechol aminocarboxylate, 20% active (wt %) | 22.3 | 0 | 0 | 0 | 0 |
| Tiron aminocarboxylate, 27% active (wt %) | 0 | 16.5 | 0 | 0 | 0 |

TABLE 13-continued

| | Example 26 | Example 27 | Example 28 | Example 29 | Comp. Ex. J |
|---|---|---|---|---|---|
| 4-methylcatechol aminocarboxylate, 25% active (wt %) | 0 | 0 | 29.7 | 0 | 0 |
| 3-methoxycatechol aminocarboxylate, 30% active (wt %) | 0 | 0 | 0 | 24.8 | 0 |
| DI Water | 299 | 304 | 296 | 297 | 315 |

The individual and average percent soil removal for the compositions of Examples 26-29 and Comparative Example J are listed below in Table 14. Again, two cleaning compositions were considered to perform substantially similarly when the performance of the two cleaning compositions did not vary by more than about 10%.

TABLE 14

| | Average Soil Removal (%) | | | | |
|---|---|---|---|---|---|
| Soil | Example 26 | Example 27 | Example 28 | Example 29 | Comp. Ex. J |
| Makeup on Cotton | 19.64 | 19.97 | 16.05 | 17.09 | 20.55 |
| Dirty Motor Oil on Cotton | 7.91 | 6.84 | 4.58 | 7.78 | 9.75 |
| Olive Oil and Soot on Cotton | 19.62 | 18.7 | 21.53 | 20.69 | 19.3 |
| Olive Oil and Soot on Polycotton | 22.73 | 22.2 | 25.66 | 21.17 | 24.06 |
| Dust Sebum on Polycotton | 40.34 | 45.08 | 54.49 | 48.18 | 57.29 |
| Dust Sebum on Cotton | 21.78 | 26.72 | 31.61 | 35.0 | 36.77 |
| Average | 22 | 23.25 | 25.65 | 24.98 | 27.95 |
| Std. Deviation | 2.25 | 0.9 | 2.05 | 1.01 | 2.98 |

As can be seen in Table 14, at a 1:0.75 weight ratio of EDTA to catechol aminocarboxylate (Example 26) or tiron aminocarboxylate (Example 27), the cleaning compositions of Examples 26 and 27 underperformed compared to the control (Comparative Example J). Without taking into account the standard deviation, the cleaning composition of Comparative Example J outperformed the composition of Example 26 by about 21.3% and the composition of Example 27 by about 16.8%. When the standard deviation is taken into account, the composition of Comparative Example J only outperformed the composition of Example 26 by about 3% and the composition of Example 27 by about 6.5%. Thus, the catechol aminocarboxylate and tiron aminocarboxylate would be an effective replacement for EDTA in laundry detergent compositions.

As expected, when the weight ratios of EDTA to 4-methylcatechol aminocarboxylate (Example 28) and 3-methoxycatechol aminocarboxylate (Example 29) were increased to about 1.25:1, the 4-methylcatechol aminocarboxylate and 3-methoxycatechol aminocarboxylate performed substantially similarly to the control (Comparative Example J). Without taking into account the standard deviation, the control only outperformed the cleaning composition of Example 28 by about 8.2% and the cleaning composition of Example 29 by about 10.6%. Thus, the 4-methylcatechol aminocarboxylate and 3-methoxycatechol aminocarboxylate would be an effective replacement for EDTA in laundry detergent compositions.

The invention has been described with reference to various specific and preferred embodiments and techniques. However, it should be understood that many variations and modifications may be made while remaining within the spirit and scope of the invention.

The invention claimed is:

1. A detergent composition for preventing calcium, magnesium and iron precipitation and for removing soils, the detergent composition comprising:

(a) a caustic;

(b) a surfactant; and (c) an aminocarboxylate functionalized catechol;

(d) wherein the aminocarboxylate functionalized catechol has the formula:

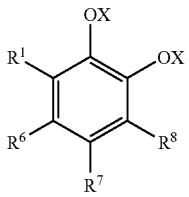

wherein:

$R^1$ is $NR^3R^4$ or $R^2NR^3R^4$, $R^2$ is selected from the group consisting of a lower alkyl group from about 1 to about 4 carbon atoms, at least one of $R^3$ and $R^4$ is $R^5(COOH)_2$, $R^5$ is selected from the group consisting of lower linear alkyl from about 1 to about 4 carbon atoms, $R^6$, $R^7$ and $R^8$ are selected from the group consisting of: hydrogen, $SO_3X$, COOX, halogen, alkoxy group, a lower alkyl group from about 1 to about 4 carbon atoms, an amine having the general formula —$N(R^9)_2$ where $R^9$ is a lower alkyl group from about 1 to about 4 carbon atoms, a hydroxyalkyl group from about 1 to about 4 carbon atoms or any combination thereof, and X is selected from the group consisting of hydrogen, an alkali metal ion, one half of an alkaline earth metal ion, and an ammonium ion with the general formula:

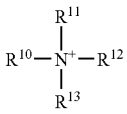

wherein each of $R^{10}$, $R^{11}$, $R^{12}$ and $R^{13}$ is a lower alkyl group from about 1 to about 4 carbon atoms, a hydroxyalkyl group from about 1 to about 4 carbon atoms or any combination thereof.

2. The detergent composition of claim 1, wherein the aminocarboxylate functionalized catechol is at least one of: catechol aminocarboxylate, tiron aminocarboxylate, 4-methycatechol aminocarboxylate and 3-methoxy cathechol aminocarboxylate.

3. The detergent composition of claim 1, wherein the aminocarboxylate functionalized catechol comprises catechol aminocarboxylate.

4. The detergent composition of claim 1, wherein the aminocarboxylate functionalized catechol comprises tiron aminocarboxylate.

5. The detergent composition of claim 1, wherein the caustic is at least one of an alkali metal hydroxide, alkali metal carbonate, and alkali metal silicate.

6. The detergent composition of claim 1, wherein the aminocarboxylate functionalized catechol constitutes between about 1% and about 40% of the composition by weight.

7. A biodegradable detergent composition for preventing calcium, magnesium and iron precipitation and for removing soils, the detergent composition comprising:

(a) an alkalinity source constituting between about 1% and about 40% by weight of the composition;

(b) a surfactant constituting between about 1% and about 25% by weight of the composition; and (c) an aminocarboxylate functionalized catechol constituting between about 1% and about 40% by weight of the composition;

(d) wherein the aminocarboxylate functionalized catechol has the formula:

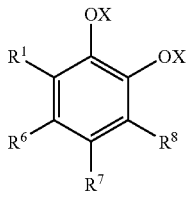

wherein:

$R^1$ is $NR^3R^4$ or $R^2NR^3R^4$, $R^2$ is selected from the group consisting of a lower alkyl group from about 1 to about 4 carbon atoms, at least one of $R^3$ and $R^4$ is $R^5(COOH)_2$, $R^5$ is selected from the group consisting of lower linear alkyl from about 1 to about 4 carbon atoms, $R^6$, $R^7$ and $R^8$ are selected from the group consisting of: hydrogen, $SO_3X$, COOX, halogen, alkoxy group, a lower alkyl group from about 1 to about 4 carbon atoms, an amine having the general formula —$N(R^9)_2$ where $R^9$ is a lower alkyl group from about 1 to about 4 carbon atoms, a hydroxyalkyl group from about 1 to about 4 carbon atoms or any combination thereof, and X is selected from the group consisting of hydrogen, an alkali metal ion, one half of an alkaline earth metal ion, and an ammonium ion with the general formula:

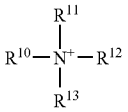

wherein each of $R^{10}$, $R^{11}$, $R^{12}$ and $R^{13}$ is a lower alkyl group from about 1 to about 4 carbon atoms, a hydroxyalkyl group from about 1 to about 4 carbon atoms or any combination thereof.

8. The biodegradable cleaning composition of claim 7, wherein the aminocarboxylate functionalized catechol constitutes between about 2% and about 20% of the cleaning composition by weight.

9. The biodegradable cleaning composition of claim 7, wherein the alkalinity source is at least one of an alkali metal hydroxide, alkali metal carbonate, and alkali metal silicate.

10. The biodegradable cleaning composition of claim 7, wherein the aminocarboxylate functionalized catechol is at least one of: catechol aminocarboxylate, tiron aminocarboxylate, 4-methycatechol aminocarboxylate and 3-methoxy cathechol aminocarboxylate.

11. The biodegradable cleaning composition of claim 7, wherein the aminocarboxylate functionalized catechol is at least one of: catechol aminocarboxylate and tiron aminocarboxylate.

12. The biodegradable cleaning composition of claim 7, wherein the cleaning composition comprises less than about 10% NTA by weight.

13. The biodegradable cleaning composition of claim 7, wherein the cleaning composition comprises less than about 10% EDTA by weight.

14. The biodegradable cleaning composition of claim 7, wherein the cleaning composition comprises less than about 10% phosphorous-containing compounds by weight.

15. A method of preventing precipitation of calcium, magnesium and iron and removing soils, the method comprising:

(a) forming a use solution by mixing an alkalinity source, a surfactant, an aminocarboxylate functionalized catechol and water;

(b) applying the use solution to a surface; and (c) rinsing the use solution from the surface;

(d) wherein the aminocarboxylate functionalized catechol has the formula:

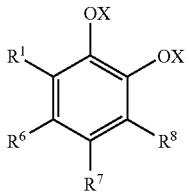

wherein:

$R^1$ is $NR^3R^4$ or $R^2NR^3R^4$, $R^2$ is selected from the group consisting of a lower alkyl group from about 1 to about 4 carbon atoms, at least one of $R^3$ and $R^4$ is $R^5(COOH)_2$, $R^5$ is selected from the group consisting of lower linear alkyl from about 1 to about 4 carbon atoms, $R^6$, $R^7$ and $R^8$ are selected from the group consisting of: hydrogen, $SO_3X$, COOX, halogen, alkoxy group, a lower alkyl group from about 1 to about 4 carbon atoms, an amine having the general formula —$N(R^9)_2$ where $R^9$ is a lower alkyl group from about 1 to about 4 carbon atoms, a hydroxyalkyl group from about 1 to about 4 carbon atoms or any combination thereof, and X is selected from the group consisting of hydrogen, an alkali metal ion, one half of an alkaline earth metal ion, and an ammonium ion with the general formula:

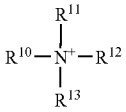

wherein each of $R^{10}$, $R^{11}$, $R^{12}$ and $R^{13}$ is a lower alkyl group from about 1 to about 4 carbon atoms, a hydroxyalkyl group from about 1 to about 4 carbon atoms or any combination thereof.

16. The method of claim 15, wherein the aminocarboxylate functionalized catechol is at least one of: catechol aminocarboxylate, tiron aminocarboxylate, 4-methycatechol aminocarboxylate and 3-methoxy catechol aminocarboxylate.

17. The method of claim 15, wherein forming the use solution comprises diluting a concentrate including the alkalinity source, surfactant and aminocarboxylate functionalized catechol at a dilution ratio of between about 250:1 and about 500:1 water to aminocarboxylate functionalized catechol.

18. The method of claim 15, wherein the use solution has an aminocarboxylate functionalized catechol concentration of at least about 10 parts per million.

19. The method of claim 15, wherein applying the use solution to a surface comprises applying the use solution to one of a textile and a hard surface.

* * * * *